US011795411B2

(12) United States Patent
Monden et al.

(10) Patent No.: US 11,795,411 B2
(45) Date of Patent: Oct. 24, 2023

(54) LUBRICATING OIL COMPOSITION, METHOD FOR PRODUCING SAME AND VACUUM APPARATUS

(71) Applicant: SHOWA DENKO K.K., Tokyo (JP)

(72) Inventors: Ryuji Monden, Tokyo (JP); Kunio Kondo, Tokyo (JP)

(73) Assignee: Resonac Corporation, Tokyo (JP)

( * ) Notice: Subject to any disclaimer, the term of this patent is extended or adjusted under 35 U.S.C. 154(b) by 0 days.

(21) Appl. No.: 17/605,282

(22) PCT Filed: Apr. 23, 2020

(86) PCT No.: PCT/JP2020/017413
§ 371 (c)(1),
(2) Date: Oct. 21, 2021

(87) PCT Pub. No.: WO2020/218386
PCT Pub. Date: Oct. 29, 2020

(65) Prior Publication Data

US 2022/0220409 A1 Jul. 14, 2022

(30) Foreign Application Priority Data

Apr. 24, 2019 (JP) ..... 2019-083392

(51) Int. Cl.

| | |
|---|---|
| ***C10M 125/02*** | (2006.01) |
| ***C10M 105/04*** | (2006.01) |
| ***C10M 109/00*** | (2006.01) |
| ***C10M 169/04*** | (2006.01) |
| ***C10M 177/00*** | (2006.01) |
| *C10N 40/30* | (2006.01) |
| *C10N 70/00* | (2006.01) |

(52) U.S. Cl.
CPC ..... *C10M 125/02* (2013.01); *C10M 105/04* (2013.01); *C10M 109/00* (2013.01); *C10M 169/04* (2013.01); *C10M 177/00* (2013.01); *C10M 2201/041* (2013.01); *C10M 2203/045* (2013.01); *C10N 2040/30* (2013.01); *C10N 2070/00* (2013.01)

(58) Field of Classification Search
CPC ..... C10M 125/02; C10M 105/04; C10M 109/00; C10M 169/04; C10M 177/00; C10M 2201/041; C10M 2203/045; C10N 2040/30; C10N 2070/00
See application file for complete search history.

(56) References Cited

U.S. PATENT DOCUMENTS

| | | | | |
|---|---|---|---|---|
| 5,292,444 | A | 3/1994 | Patil et al. | |
| 5,462,680 | A | 10/1995 | Brois et al. | |
| 5,503,643 | A | 4/1996 | Schriver et al. | |
| 8,883,124 | B2 | 11/2014 | Krishna et al. | |
| 11,214,749 | B2 | 1/2022 | Monden et al. | |
| 2002/0031615 | A1 | 3/2002 | Dykes et al. | |
| 2014/0312281 | A1* | 10/2014 | Jackson | C07C 13/64 585/27 |
| 2015/0162044 | A1* | 6/2015 | Hanawa | C10M 103/02 427/127 |
| 2016/0160148 | A1* | 6/2016 | Rai | C10M 125/02 508/116 |
| 2019/0032971 | A1 | 1/2019 | Ishida et al. | |
| 2020/0194677 | A1* | 6/2020 | Richter | C08K 9/04 |
| 2020/0299601 | A1* | 9/2020 | Horie | C09J 7/22 |
| 2020/0339904 | A1* | 10/2020 | Monden | C10M 169/04 |
| 2021/0222083 | A1* | 7/2021 | Monden | C10M 125/02 |
| 2021/0253968 | A1* | 8/2021 | Kato | G11B 5/7257 |
| 2021/0371763 | A1* | 12/2021 | Monden | C10M 169/04 |
| 2021/0371769 | A1 | 12/2021 | Monden et al. | |
| 2022/0186136 | A1* | 6/2022 | Monden | C10M 177/00 |
| 2022/0220409 | A1* | 7/2022 | Monden | C10M 169/04 |
| 2022/0228084 | A1* | 7/2022 | Monden | C10M 125/02 |

FOREIGN PATENT DOCUMENTS

| | | | | |
|---|---|---|---|---|
| CN | 1441854 | A | 9/2003 | |
| CN | 101155902 | A | 4/2008 | |
| CN | 104762122 | A | 7/2015 | |
| CN | 105523924 | A | 4/2016 | |
| CN | 108865347 | A | 11/2018 | |
| EP | 0544513 | A1 | 6/1993 | |
| EP | 3702435 | A1 * | 9/2020 | C10M 125/02 |
| JP | 05-116922 | A | 5/1993 | |
| JP | 05-254815 | A | 10/1993 | |
| JP | 05-254989 | A | 10/1993 | |
| JP | 09-74216 | A | 3/1997 | |
| JP | 10-140169 | A | 5/1998 | |
| JP | 11-515053 | A | 12/1999 | |
| JP | 2004-231739 | A | 8/2004 | |
| JP | 2005-089667 | A | 4/2005 | |
| JP | 2005-154755 | A | 6/2005 | |
| JP | 2005-336309 | A | 12/2005 | |
| JP | 2008-266501 | A | 11/2008 | |
| JP | 2017-88757 | A | 5/2017 | |
| KR | 10-2014-0103523 | A | 8/2014 | |
| WO | 97/16510 | A1 | 5/1997 | |
| WO | 2014/126315 | A1 | 8/2014 | |
| WO | 2015/192075 | A1 | 12/2015 | |
| WO | 2017/141825 | A1 | 8/2017 | |
| WO | 2019/004275 | A1 | 1/2019 | |
| WO | 2019/082917 | A1 | 5/2019 | |

OTHER PUBLICATIONS

International Search Report for PCT/JP2020/017413, dated Jul. 21, 2020.

(Continued)

*Primary Examiner* — Ellen M Mcavoy
(74) *Attorney, Agent, or Firm* — Sughrue Mion, PLLC

(57) ABSTRACT

A lubricating oil composition is provided, including a fullerene and a base oil, in which the fullerene is a fullerene sublimate, and the base oil is a multiply alkylated cyclopentane oil or an ionic liquid.

18 Claims, No Drawings

(56) References Cited

OTHER PUBLICATIONS

Office Action dated Dec. 21, 2022 in U.S. Appl. No. 17/605,320.
Office Action dated Mar. 22, 2022 issued by the China National Intellectual Property Administration in Chinese Application No. 202080030403.4.
"Vacuum Technology—Vocabulary—Part 1:General terms", JIS Z 8126-1:1999 (13 pages total).
International Search Report for PCT/JP2020/017423, dated Jul. 14, 2020.
A. Nigam, et al., "Lattice-type Polymers from an Adduct of [60]Fullerene and 2-Methylaziridine", Journal of the Chemical Society—Chemical Communications, vol. 15, Dec. 31, 1995, pp. 1547-1548 (2 pages total).
Wenchao Guan et al., "Preliminary study on synthesis and lubrication mechanism of polyhydroxyfullerene derivatives", 1998 China Materials Seminar, Dec. 31, 1998, pp. 191-194 (4 pages total).
Xuefeng Li, et al., "Fabrication and atomic force microscopy/friction force microscopy (AFM/FFM) studies of polyacrylamide-carbon nanotubes (PAM-CNTs) copolymer thin films", Materials Chemistry and Physics, vol. 88, Issue 1, Dec. 31, 2004, pp. 53-58 (6 pages total).
Office Action dated Mar. 21, 2022 from the China National Intellectual Property Administration in CN Application No. 202080030347.4.
International Search Report for PCT/JP2020/017424, dated Jul. 21, 2020.

* cited by examiner

LUBRICATING OIL COMPOSITION, METHOD FOR PRODUCING SAME AND VACUUM APPARATUS

CROSS REFERENCE TO RELATED APPLICATIONS

This application is a National Stage of International Application No. PCT/JP2020/017413, filed Apr. 23, 2020, claiming priority to Japanese Patent Application No. 2019-083392, filed Apr. 24, 2019, the contents of all of which are incorporated herein by reference in their entirety.

TECHNICAL FIELD

The present invention relates to a lubricating oil composition, a method for producing the same, and a vacuum apparatus.

BACKGROUND ART

Lubricating oil compositions that can be used under high vacuum are required to have properties which are different from those of usual lubricating oil compositions, such as a low vapor pressure and substantially no inclusion of volatile components.

Patent Document 1 proposes a lubricating oil composition in which a perfluoroalkyl ether (PFAE), tris(2-octyldodecyl) cyclopentane, or the like having a low vapor pressure is used as a base oil.

Patent Document 2 proposes an antistatic lubricating oil composition containing an antistatic substance selected from ionic liquids consisting of a nitrogen onium cation and a weakly coordinating fluorine-containing organic anion or a weakly coordinating fluorine-containing inorganic anion, and a lithium compound such as lithium bis(trifluoromethanesulfonyl)imide.

Patent Document 3 proposes a semi-solid lubricating oil composition consisting of an ionic liquid which has a low vapor pressure and a conductivity which achieves antistatic.

Patent Document 4 proposes, as a lubricating oil composition having heat resistance and antioxidant properties, a lubricating oil composition containing (a) at least one base oil selected from the group consisting of an ionic liquid and a fluorine-free synthetic oil having a vapor pressure of $1\times10^{-4}$ Torr or less at 25° C. and (b) at least one selected from the group consisting of a fullerene compound and carbon particles by-produced in the production of a fullerene.

CITATION LIST

Patent Document

Patent Document 1: Japanese Unexamined Patent Application, First Publication No. H10-140169

Patent Document 2: Japanese Unexamined Patent Application, First Publication No. 2005-89667

Patent Document 3: Japanese Unexamined Patent Application, First Publication No. 2005-154755

Patent Document 4: Japanese Unexamined Patent Application, First Publication No. 2005-336309

SUMMARY OF INVENTION

Technical Problem

However, for example, regarding the application of lubricating oil used in outer space, it is expected that the physical properties of the lubricating oil composition of any of the aforementioned proposals will change, as the lubricating oil compositions are placed in a harsh environment where they are exposed to high-energy rays such as cosmic rays under high vacuum. Accordingly, the proposals are not sufficient to stably maintain lubricating performance over a long period of time.

More specifically, the change in physical properties of a lubricating oil composition occurs because molecules of a base oil constituting the lubricating oil composition are gradually cleaved and molecular chains of the base oil are shortened. In particular, in a lubricating oil composition used under high vacuum, an increase in vapor pressure of the lubricating oil composition is caused by production of components having a small molecular weight. This increase in vapor pressure causes various problems as described below. The series of changes of a base oil is called "deterioration of a base oil". The deterioration of a base oil may be caused not only by high-energy rays but also by heat generation due to frictional wear in a case where an extreme force is applied to a sliding portion.

Due to the increase in vapor pressure caused by the deterioration of a base oil, some of the base oil may evaporate and be lost during use, and the amount of lubricating oil in a sliding portion may decrease. As a result, the sliding portion becomes worn, which may cause seizure. In addition, when some of the base oil evaporates, lubricating oil may also be dispersed and adhere to portions other than a sliding portion of a mechanical device, thereby contaminating the mechanical device.

In addition, in the lubricating oil composition containing a fullerene, although various lubrication characteristics have been improved, the vapor pressure thereof at an initial stage of use could not be lowered to the same extent as that of a base oil. The reason the vapor pressure of the lubricating oil composition at an initial stage of use is high is thought to be due to the influence of residues of a volatile component such as organic solvents because such a volatile component is usually used in a step of producing a fullerene.

An object of the present invention is to provide a lubricating oil composition which has a low vapor pressure and in which excellent abrasion resistance can be exhibited, an increase in vapor pressure due to deterioration of a base oil can be suppressed, and lubricating performance can be stably maintained over a long period of time even under vacuum; a method for producing the same; and a vacuum apparatus.

Solution to Problem

A first aspect of the present invention is the following lubricating oil composition. [1] A lubricating oil composition, including a fullerene and a base oil, in which the fullerene is a fullerene sublimate, and the base oil is a multiply alkylated cyclopentane oil or an ionic liquid.

The first aspect of the present invention preferably includes characteristics described in [2] below.

[2] The lubricating oil composition according to [1] above, further including: a fullerene adduct, wherein the fullerene adduct has a structure in which an additional group has been added to the fullerene, wherein the additional group has a part of a molecular structure which constitutes the base oil.

A second aspect of the present invention is the following method for producing a lubricating oil composition.

[3] A method for producing the lubricating oil composition according to [1] or [2] above, the method including: a dissolution step of dissolving a fullerene sublimate in a base oil to obtain a fullerene solution.

The second aspect of the present invention preferably includes characteristics described in [4] to [14] below. The following characteristics are preferably combined with each other.

[4] The method for producing a lubricating oil composition according to [3] above, the method further including: a sublimation step of sublimating and vaporizing a raw material fullerene in a non-oxidizing atmosphere, and then cooling and solidifying the vaporized fullerene to obtain the fullerene sublimate before the dissolution step.

[5] The method for producing a lubricating oil composition according to [3] or [4] above, in which the fullerene sublimate contains $C_{60}$ or $C_{70}$ or a mixture thereof.

[6] The method for producing a lubricating oil composition according to any one of [3] to [5], the method further including: a removal step of removing insoluble components from the fullerene solution after the dissolution step.

[7] The method for producing a lubricating oil composition according to any one of [3] to [6] above, the method further including: a heat treatment step of subjecting the fullerene solution to a heat treatment in a non-oxidizing atmosphere after the dissolution step to produce a fullerene adduct.

[8] The method for producing a lubricating oil composition according to [7] above, in which a temperature during the heat treatment in the heat treatment step is within a range of higher than an upper limit usage temperature of the base oil and lower than or equal to the upper limit usage temperature +200° C.

[9] The method for producing a lubricating oil composition according to [7] above, in which a temperature of the heat treatment in the heat treatment step is 150° C. to 300° C.

[10] The method for producing a lubricating oil composition according to any one of [3] to [6] above, the method further including: a radiation treatment step of irradiating the fullerene solution with radiation in a non-oxidizing atmosphere after the dissolution step to produce a fullerene adduct, in which the radiation is ultraviolet light or ionizing radiation.

[11] The method for producing a lubricating oil composition according to [10] above, in which the radiation is ultraviolet light having a wavelength of 190 nm to 365 nm.

[12] The method for producing a lubricating oil composition according to [10 or [11] above, in which the amount of energy of the radiation emitted in the radiation treatment step is 1 J to 100 J per milliliter of the fullerene solution.

[13] The method for producing a lubricating oil composition according to any one of [7] to [12] above, in which an oxygen partial pressure in the non-oxidizing atmosphere is less than or equal to 10 pascals.

[14] The method for producing a lubricating oil composition according to any one of [7] to [13] above, in which the heat treatment step or the radiation treatment step is performed until a concentration of the fullerene in the fullerene solution is 0.1 times to 0.7 times a concentration of the fullerene obtained before the heat treatment step or the radiation treatment step.

[15] The method for producing a lubricating oil composition according to [14] above, in which a treatment time of the heat treatment step or the radiation treatment step is 5 minutes to 24 hours.

A third embodiment of the present invention is the following vacuum apparatus.

[16] A vacuum apparatus, including: a vacuum container in which the lubricating oil composition according to [1] or [2] above is used therein.

Advantageous Effects of Invention

According to the present invention, it is possible to provide a lubricating oil composition which has a low vapor pressure and in which excellent abrasion resistance can be exhibited, an increase in vapor pressure due to deterioration of a base oil can be suppressed, and lubricating performance can be stably maintained over a long period of time even under vacuum; a method for producing the same; and a vacuum apparatus.

DESCRIPTION OF EMBODIMENTS

Hereinafter, a lubricating oil composition and a method for producing the same according to an embodiment of the present invention will be described. The present embodiment is specifically described to facilitate better understanding of the gist of the invention, and does not limit the present invention unless otherwise specified.

Numerical values, orders, times, ratios, materials, amounts, configurations, and the like can be, for example, modified, added, omitted, or replaced within the scope not departing from the gist of the present invention.

(Lubricating Oil Composition)

The lubricating oil composition according to the present embodiment includes a fullerene and a base oil, in which the above-described fullerene is a fullerene sublimate, and the above-described base oil is a multiply alkylated cyclopentane oil or an ionic liquid. In addition, the lubricating oil composition of the present embodiment may contain a fullerene adduct, an additive, and the like to be described below.

(Fullerene Sublimate)

In general, a fullerene production process includes a step of handling a fullerene in a volatile organic solvent, for example, extracting a fullerene from soot with an organic solvent such as toluene. For this reason, molecules of the organic solvent are easily incorporated into the obtained fullerene crystal grains. If such a fullerene is used, volatile components such as molecules of the organic solvent may be also mixed. Accordingly, a lubricating oil composition having a low vapor pressure cannot be obtained. If the above-described volatile components are contained, in a case where, for example, a lubricating oil composition is used under high vacuum, the volatile components are volatilized. At this time, some of a base oil or fullerene are also scattered in a liquid state. For this reason, portions other than a sliding portion of a mechanical device are contaminated.

In order to prevent this incorporation or contamination, in the present embodiment, a fullerene substantially free of volatile components is used. That is, the fullerene contained in the lubricating oil composition of the present embodiment is a fullerene sublimate. The "fullerene sublimate" is a fullerene substantially free of volatile components. A method for producing a fullerene sublimate will be described in detail in "Sublimation Step" to be described below.

Here, in a case where molecules of an organic solvent are incorporated into fullerene crystal grains, the above-described volatile components are also incorporated into the crystal grains. For this reason, it is very difficult to quantitatively analyze the volatile components in the fullerene. Therefore, in the present embodiment, in a case where it can be stated that the level of increase in a degassing degree described below of a fullerene solution, which is produced by dissolving a fullerene sample in a base oil, is substantially 0 (for example, less than or equal to 0.1) compared to the base oil, it can be determined that this sample is substantially free of volatile components.

Examples of the types of the fullerene included in the fullerene sublimate include $C_{60}$, $C_{70}$, high-order fullerenes, and a mixture thereof. Among these fullerenes, $C_{60}$ or $C_{70}$ or a mixture thereof is preferable as the fullerene from the viewpoint of high solubility in lubricating oils. A fullerene mixture, in which 50 mass % or more of $C_{60}$ is contained, is more preferable as the fullerene from the viewpoint of less brown to black-based discoloration of a lubricating oil (from the viewpoint that deterioration of a lubricating oil composition is easily determined by color). The content thereof may be 70 mass % to 100 mass %, or may be 90 mass % to 100 mass %. A fullerene sublimate composed of only $C_{60}$ is still more preferable.

The concentration of the fullerene sublimate in a lubricating oil composition can be arbitrarily selected, and is preferably, for example, 0.0001 mass % to 0.010 mass %, 0.0005 mass % to 0.008 mass %, 0.001 mass % to 0.005 mass %, or 0.002 mass % to 0.003 mass % as necessary. However, the present invention is not limited to these examples.

(Fullerene Adduct)

The lubricating oil composition of the present embodiment may contain a fullerene adduct. The fullerene adduct has a structure in which an additional group which has a part of a molecular structure constituting the above-described base oil is added to the above-described fullerene.

The concentration of the fullerene adduct in a lubricating oil composition can be arbitrarily selected, and is preferably, for example, 0.0001 mass % to 0.010 mass %, 0.0005 mass % to 0.008 mass %, 0.001 mass % to 0.005 mass %, or 0.002 mass % to 0.003 mass %. However, the present invention is not limited to these examples. The concentration of the fullerene adduct may be obtained through an arbitrarily selected method. For example, the concentration thereof may be estimated from the difference between fullerene concentrations before and after a heat treatment as will be described below.

(Base Oil)

The base oil contained in the lubricating oil composition of the present embodiment is an oil having a low vapor pressure. Preferred examples thereof include a multiply alkylated cyclopentane oil or an ionic liquid such as dialkylpiperidin bis(trifluoromethanesulfonyl)imide.

It is preferable that no volatile components be contained in the base oil. Specifically, the base oil has a vapor pressure at 25° C. of preferably 1 pascal or less, more preferably 0.1 pascals or less, and particularly preferably 0.01 pascals or less.

Molecules of a multiply alkylated cyclopentane oil (hereinafter, sometimes referred to as a "MAC oil") have a structure in which a plurality of alkyl groups are bonded to a cyclopentane ring. The total number of carbon atoms of these alkyl groups is preferably 48 to 112. The total number of carbon atoms may be, for example, 48 to 60, 48 to 80, or 70 to 112. The numbers of carbon atoms in each alkyl group may be the same as or different from each other. The number of alkyl groups binding to a cyclopentane ring can also be arbitrarily selected and may be, for example, 1 to 5, 2 to 4, or 3 or 4. More specific examples thereof include tris(2-octyldodecyl)cyclopentane to which three alkyl groups having 20 carbon atoms are bonded thereto, tetra(dodecyl) cyclopentane to which four alkyl groups having 12 carbon atoms are bonded thereto, and a mixture thereof. However, the present invention is not limited to these examples.

An ionic liquid is an ionic compound which contains a cationic moiety and an anionic moiety, and is particularly preferably a liquid at room temperature to 80° C. because in this case it is easy to handle.

Examples of the above-described anionic moieties include bis(trifluoromethanesulfonyl)imide, bis(fluorosulfonyl)imide, and diethyl phosphate.

In addition, examples of the above-described cationic moieties include lithium, cyclohexyltrimethylammonium, ethyldimethylphenylethylammonium, methyltrioctylammonium, 1-aryl-3-methylimidazolium, 1-ethyl-3-methylimidazolium, 1-butyl-3-methylimidazolium, 1-hexyl-3-methylimidazolium, 1-butyl-2,3-diethylimidazolium, 3,3'-(butane-1,4-diyl) bis(1-vinyl-3-imidazolium), 1-decyl-3-methylimidazolium, 1-butyl-4-methylpyridium, 4-ethyl-4-methylmorpholinium, tetrabutylphosphonium, tributyl(2-methoxyethyl)phosphonium, trihexyl(tetradecyl) phosphonium, butyl-1-methylpiperidinium, 1-butylpyridium, 1-butyl-methylpyrrolidinium, and tributylsulfonium.

Specific examples of ionic liquids include a compound obtained by appropriately combining a compound of the cationic moiety and a compound of the anionic moiety. The compound of the cationic moiety and the compound of the anionic moiety to be combined may not limited to be a single kind. That is, one or more kinds of the compounds may be combined with each other.

The amount of base oil in a lubricating oil composition can be arbitrarily selected. For example, the amount thereof may be 90.0000 mass % to 99.9999 mass %. However, the present invention is not limited to these examples.

(Additives)

The lubricating oil composition of the present embodiment can contain additives substantially containing no volatile components within a range not impairing the effects of the lubricating oil composition in addition to the base oil, the fullerene sublimate, and the fullerene adduct. Examples of additives include antioxidants, viscosity index improvers, extreme pressure additives, detergent dispersants, pour point depressants, corrosion inhibitors, solid lubricants, oiliness improvers, rust preventive additives, anti-emulsifiers, anti-foaming agents, and hydrolysis inhibitors which are commercially available. Such additives may be used alone or in a combination of two or more thereof. The amount of additives can be arbitrarily selected.

Examples of antioxidants include butylhydroxyanisole (BHA) and dialkyldiphenylamines.

Examples of viscosity index improvers include hydride additives of polyalkylstyrenes or styrene-diene copolymers.

Examples of extreme pressure additives include dibenzyl disulfide, an allyl phosphate ester, an allyl phosphite ester, an amine salt of an allyl phosphate ester, an allyl thiophosphate ester, and an amine salt of an allyl thiophosphate ester.

Examples of detergent dispersants include benzylamine succinic acid derivatives, and alkylphenol amines.

Examples of pour point depressants include chlorinated paraffin-naphthalene condensates, chlorinated paraffin-phenol condensates, and polyalkylstyrene-based pour point depressants.

Examples of anti-emulsifiers include alkylbenzene sulfonates.

Examples of corrosion inhibitors include dialkylnaphthalene sulfonates.

(Method for Producing Lubricating Oil Composition)

The method for producing a lubricating oil composition of the present embodiment includes a dissolution step of dissolving the above-described fullerene sublimate in the above-described base oil to obtain a fullerene solution. Although the fullerene solution obtained in this step may be used as a lubricating oil composition as it is, a further processed fullerene solution may be used as a lubricating oil composition as described below.

The above-described fullerene sublimate used in the dissolution step preferably contains $C_{60}$ or $C_{70}$ or a mixture thereof from the viewpoint of high solubility in the lubricating oil as described above. A fullerene mixture in which 50 mass % or more of $C_{60}$ is contained is more preferable from the viewpoint of less discoloration of the lubricating oil. A fullerene sublimate composed of $C_{60}$ is still more preferable.

The concentration of a fullerene in a fullerene solution is arbitrarily selected and is, for example, preferably 1 mass ppm (0.0001 mass %) to 100 mass ppm (0.01 mass %), more preferably 3 mass ppm (0.0003 mass %) to 75 mass ppm (0.0075 mass %), and still more preferably 5 mass ppm (0.0005 mass %) to 50 mass ppm (0.005 mass %). The concentration of the fullerene may be measured through an arbitrarily selected method, for example, a technique using high-performance liquid chromatography (HPLC).

The dissolution in the above-described dissolution step can be performed through an arbitrarily selected method and can be preferably performed through ordinary mechanical stirring, ultrasonic stirring, or the like. Regarding the temperature, in a case where a base oil is a low-viscosity liquid at room temperature, the base oil can be stirred at room temperature. On the other hand, in a case where a base oil is a high-viscosity liquid or solid at room temperature, the base oil is preferably turned into a low-viscosity liquid through heating, and then is stirred to perform dissolution. The stirring time may be arbitrarily selected.

(Sublimation Step)

The above-described fullerene sublimate used in the dissolution step may be commercially available products or may be produced using ordinary fullerenes (raw material fullerene) by providing a sublimation step. That is, the above-described method for producing a lubricating oil composition may further include a sublimation step of sublimating and vaporizing a raw material fullerene in a non-oxidizing atmosphere before the dissolution step, and then cooling and solidifying the vaporized fullerene to obtain the above-described fullerene sublimate. For example, a raw material fullerene can be sublimated and vaporized in a non-oxidizing atmosphere in which the oxygen gas partial pressure is less than or equal to 10 pascals to form a gas, and can then be cooled and solidified to obtain the above-described fullerene sublimate. The raw material fullerene may mean fullerenes which are not obtained in the sublimation step, and commercially available products may be used.

By providing the sublimation step, the dissolution step can be performed continuously after the sublimation step. This method is preferable from the viewpoint of preventing incorporation of volatile components from air or the like by avoiding storage of the obtained fullerene sublimate.

In the sublimation step, specifically, a raw material fullerene can be sublimated using, for example, a commercially available sublimation purification device. As an example of sublimation, a raw material fullerene is first placed in a heating unit inside a sublimation purification device, and the inside of the device is depressurized in this state to reduce the oxygen gas partial pressure to 10 pascals or less. After the depressurization, the heating unit is heated to change a phase of the raw material fullerene in the heating unit from a solid to a gas. Thereafter, the raw material fullerene is phase-changed from a gas to a solid through cooling and precipitated as a fullerene sublimate. According to this method, since the raw material fullerene is temporarily in a gas molecule state, volatile components contained in crystals of the raw material fullerene can be removed. The fullerene sublimate obtained in this manner does not substantially contain the volatile components. Accordingly, by providing the sublimation step, a lubricating oil composition having a low vapor pressure can be obtained.

(Removal Step)

The fullerene solution obtained in the dissolution step sometimes contains insoluble fullerenes or the like. In this case, these insoluble components are preferably removed. That is, the above-described method for producing a lubricating oil composition may further include a removal step of removing insoluble components from the above-described fullerene solution after the above-described dissolution step. Methods for removing insoluble components can be arbitrarily selected, and examples thereof include a method for performing filtering with a membrane filter, a method for performing precipitation and removal using a centrifuge, and a method of using both methods in combination.

(Heat Treatment Step/Radiation Treatment Step)

A fullerene adduct can be obtained by subjecting the above-described fullerene solution to a heat treatment or a radiation treatment in a non-oxidizing atmosphere in which the oxygen partial pressure is lowered, for example. That is, the above-described method for producing a lubricating oil composition may further include a heat treatment step of subjecting the above-described fullerene solution to a heat treatment in a non-oxidizing atmosphere after the above-described dissolution step to produce the above-described fullerene adduct. In addition, the method thereof may further include a radiation treatment step of irradiating the above-described fullerene solution with radiation in a non-oxidizing atmosphere after the above-described dissolution step to produce the above-described fullerene adduct.

The fullerene adduct may be obtained by performing one or both of the heat treatment step and the radiation treatment step or may be obtained by performing both of the heat treatment step and the radiation treatment step at the same time.

By performing such treatments, a part of a molecular structure constituting a base oil is cleaved, and as a result, highly reactive molecules (hereinafter, sometimes simply referred to as "cleaved molecules") are produced. The cleaved molecules are added to a fullerene to produce a fullerene adduct. The fullerene adduct obtained through these treatments has a structure in which an additional group which has a part of a molecular structure constituting the above-described base oil has been added to the fullerene. An excellent effect can be obtained through the production of the fullerene adduct.

The change of the fullerene to the fullerene adduct can be confirmed by performing mass spectrum measurement on the fullerene solution before and after the treatments. For example, in a case where $C_{60}$ is used as a fullerene sublimate, only the peak of m/z=720 corresponding to $C_{60}$ is confirmed in a lubricating oil composition before performing a heat treatment or a radiation treatment. On the other hand, in a lubricating oil composition after such treatments, the peak of 720 is reduced in size, and a plurality of peaks of the fullerene adduct appear. As the main peak, a peak (722+2N) corresponding to $C_{60}$ to which a plurality of alkyl groups having different chain lengths have been added can be confirmed. N represents a natural number of 60 or less. The peaks show that two alkyl radical molecules produced through cleavage of a base oil have been added to $C_{60}$.

Since the molecules of the above-described base oil are not necessarily cleaved at a specific site, the fullerene adduct is not usually composed of a single type of molecule, and their analysis is difficult. For this reason, regarding the progress of the reaction in which the fullerene adduct is produced, the concentration of the remaining fullerene may be measured and the fullerene residual rate represented by the following equation may be used as a guideline.

Fullerene residual rate)=[concentration of fullerene after treatments]/[concentration of fullerene before treatments]

In the above-described equation, the treatments mean one or both of the heat treatment and the radiation treatment. In order to obtain a fullerene residual rate in the middle of treatments, the "concentration of fullerene after treatments" above may be replaced with "concentration of fullerene during treatments". In addition, the concentration of the fullerene can be measured through a technique using high-performance liquid chromatography (HPLC) described in examples.

The concentration of the fullerene adduct produced may be estimated by the following approximate equation.

[Concentration of fullerene adduct]≅[concentration of fullerene before treatments]/[concentration of fullerene after treatments]

The fullerene residual rate obtained by the above-described approximate equation is preferably 0.1 to 0.7 and more preferably 0.2 to 0.5. If the above-described fullerene residual rate is 0.1 to 0.7, the lubricity of a lubricating oil composition can be more stably expressed from the initial stage of use, frictional wear of a sliding portion of a mechanical device can be suppressed, and production of volatile components due to deterioration of a base oil can be suppressed.

Accordingly, in the present embodiment, it is preferable that the concentration of fullerene of a fullerene solution be monitored during the heat treatment step or the radiation treatment step, and the heat treatment step or the radiation treatment step be performed until the concentration of the fullerene in the fullerene solution is 0.1 to 0.7 with respect to the concentration of the fullerene before the above-described heat treatment step or the above-described radiation treatment step. In addition, the treatment time of the above-described heat treatment step or the radiation treatment step can be arbitrarily selected, but is preferably 5 minutes to 24 hours, which facilitates the operation of the heat treatment or the radiation treatment. Regarding adjustment of the treatment time, for example, the treatment time can be shortened by increasing the heat treatment temperature or the irradiation intensity and conversely can be prolonged by lowering the heat treatment temperature or the irradiation intensity. In addition, in the radiation treatment step, the radiation intensity, the irradiation time, and the number of times of irradiation may be arbitrarily selected. For example, as a method for setting the concentration of the fullerene to the above-described range, a method of adjusting the number of times of irradiation, for example, by repeating irradiation with radiation having a relatively high radiation intensity for a short period of time (about 0.1 seconds to 3 minutes) 2 to 10 times, is preferable since operation thereof is easy.

In general, the fullerene solution is handled in atmospheric air. For this reason, the concentration of oxygen gas in the solution is in equilibrium with oxygen gas in atmospheric air. In addition, oxygen molecules react with cleaved molecules and suppress the production of the fullerene adduct. For this reason, it is preferable that as many oxygen molecules in the fullerene solution be removed as possible and a heat treatment or a radiation treatment be performed in a non-oxidizing atmosphere. Regarding the above-described non-oxidizing atmosphere in a heat treatment step or a radiation treatment step, the oxygen partial pressure in the above-described non-oxidizing atmosphere in a gas phase in equilibrium with the fullerene solution is preferably less than or equal to 10 pascals, more preferably less than or equal to 5 pascals, and still more preferably less than or equal to 2 pascals. The oxygen partial pressure may be less than or equal to 1 pascal or less than or equal to 0.1 pascals. In addition, preferred examples of non-oxidizing atmospheres include an inert gas atmosphere as described below. Specific examples of the heat treatment step can include the following two methods, and specific examples of the radiation treatment step can include the following one method.

Heat Treatment Step

The above-described heat treatment is preferably performed at a temperature exceeding the upper limit of the usage temperature of a base oil. When the upper limit usage temperature of a base oil is exceeded, cleaved molecules are likely to be produced. Furthermore, the higher the temperature, the more cleaved molecules are produced. As a result, the heat treatment time may be short. From the viewpoint of heat treatment time for easy operation, it is preferable that the temperature of the heat treatment in this heat treatment step be within a range of higher than an upper limit usage temperature of a base oil and lower than or equal to the upper limit usage temperature +200° C. of a base oil. The upper limit usage temperature of a base oil can be ascertained from the catalog or the like of a base oil manufacturer. The upper limit usage temperature may mean the upper limit of the temperature of a base oil at which the base oil can be relatively stably used. In a case where the upper limit usage temperature of the base oil is unclear, as a guideline, the heat treatment temperature is preferably 150° C. to 300° C. and more preferably 200° C. to 250° C. The time for the heat treatment step can be arbitrarily selected, but is preferably 5 minutes to 24 hours. The time may be 5 minutes to 30 minutes, 30 minutes to 1 hour, 1 hour to 5 hours, 5 hours to 24 hours, or the like. However, the present invention is not limited to these examples.

The method for creating a non-oxidizing atmosphere can be arbitrarily selected. For example, a fullerene solution may be accommodated in an airtight container made of a metal such as stainless steel, and then the container may be sealed. Subsequently, the inside of the container may be purged with an inert gas such as nitrogen gas or argon gas and an inert gas may also be bubbled into the fullerene solution in the container. In this manner, an equilibrium is created between the fullerene solution and the inert gas, and the above-described oxygen partial pressure is set to less than or equal to 10 pascals.

Alternatively, examples of the method for creating a non-oxidizing atmosphere also include a method for depressurizing the inside of an airtight container. For example, if the inside of the container is depressurized to 10 pascals or less, the oxygen partial pressure of a gas phase can be set to 10 pascals or less, usually 2 pascals or less. When a non-oxidizing atmosphere is created through depressurization of the inside of a container in this manner and the container is heated while the state is maintained, a fullerene solution can be heat-treated.

The fullerene solution can be heated through an arbitrarily selected method. For example, the heating can be performed through a method of performing heating from outside with an oil bath, a method for performing irradiation with infrared light, or a method for performing irradiation with microwaves.

In addition, in the heat treatment step, the fullerene residual rate may be checked every time a certain period of time elapses and heating (heat treatment) may be continued until a desired fullerene residual rate is obtained.

Radiation Treatment Step

The radiation used in the above-described radiation treatment is radiation having energy to produce cleaved molecules. Specifically, the radiation is ultraviolet light or ionizing radiation and is preferably ultraviolet light. The radiation is more preferably ultraviolet light having a wavelength of 190 nm to 365 nm and still more preferably ultraviolet light having a wavelength of 330 mn to 350 nm. For example, a C—C single bond is cleaved by ultraviolet light having a wavelength of 341 nm or less. In addition, in a case of performing an irradiation treatment at normal temperature, thermal vibration is superimposed, and therefore, the C—C single bond is cleaved even by ultraviolet light having a wavelength which is slightly longer than 341 nm. Accordingly, sufficient cleaved molecules can be produced through irradiation with ultraviolet light having a wavelength of 190 nm to 365 nm. In addition, as long as cleaved molecules can be produced, low-energy radiation is preferable from the viewpoint of limiting binding sites in base oil molecules to be cleaved. For this reason, it is thought that relatively large cleaved molecules retaining partial shapes of molecules of the original base oil are likely to be obtained, and the affinity between the base oil and the obtained fullerene adduct improves.

The radiation treatment is preferably performed in a non-oxidizing atmosphere similarly to the above-described heat treatment. At the time of irradiation with radiation, a radiation source such as an ultraviolet lamp may be inserted into a container or a container may be used wherein at least a part thereof is made of a material through which radiation to be used is transmitted in order to irradiate from outside a container. For example, in a case of irradiation with ultraviolet light, the whole or a part of the above-described stainless steel container can be replaced with an element made of a material through which ultraviolet light is transmitted such as quartz glass.

The amount of energy of radiation emitted in the radiation treatment step can be arbitrarily selected and is, per one milliliter of a fullerene solution, preferably 1 J to 100 J, more preferably 1.5 J to 60 J, and still more preferably 2 J to 20 J. The amount of energy thereof may be, for example, 1 J to 10 J and 1 J to 8 J. When the amount is within the ranges, the range of the concentration of fullerene after treatments which is obtained from the above-described equation, that is, the fullerene residual rate is easily adjusted to 0.1 to 0.7. As described above, the irradiation may be performed only once, or the irradiation may be performed plural times, for example, may be divided into two or more times. The irradiation may be performed under the same conditions. In a case where the irradiation is performed plural times, the total energy amount of radiation is preferably within the above-described range. The number of times of irradiation can be arbitrarily selected and may be, for example, within a range of 1 to 10 times or a range of 2 to 5 times. However, the present invention is not limited to these examples. In addition, it is preferable that the fullerene residual rate be checked every time irradiation is performed, and the irradiation be repeated one or more times until a target fullerene residual rate is obtained.

In a case of irradiation with ultraviolet light, general low-pressure mercury lamps, UV ozone lamps, ultraviolet LEDs, excimer lamps, xenon lamps, and the like can be used. Regarding the irradiation dose of ultraviolet light, the energy density ($mW/cm^2$) of ultraviolet irradiation light is previously measured using an ultraviolet photometer, and then the irradiation time (seconds) and the irradiation range ($cm^2$) are determined. Using the obtained values, the amount of energy (J) of ultraviolet light to be emitted can be determined. The irradiation time can be arbitrarily selected. For example, the irradiation time may be 5 minutes to 24 hours. Alternatively, the irradiation time may be 0.1 seconds to 1 hour, 0.2 seconds to 30 minutes, 0.3 seconds to 3 minutes, 0.5 seconds to 60 seconds, or 1 second to 30 seconds.

According to the lubricating oil composition of the present embodiment, not only is the frictional resistance reduced and abrasion resistance excellent, but also the vapor pressure can be reduced, production of volatile components due to deterioration of a base oil can be suppressed, and an increase in vapor pressure of the lubricating oil composition can be suppressed. The lubricating oil composition of the present embodiment can be used in various applications, but is particularly suitable for use in a vacuum or in outer space.

Although the preferred embodiment of the present invention has been described in detail above, the present invention is not limited to a specific embodiment and various modifications and changes can be made within the scope of the gist of the present invention disclosed in the claims.

EXAMPLES

Hereinafter, the present invention will be described in more detail based on examples, but is not limited to these examples.

Example 1

Preparation of Lubricating Oil Composition

First, 10 g of raw material fullerene $C_{60}$ (manufactured by Frontier Carbon Corporation, Nanom™ Purple ST) was sublimated using a sublimation purification device (small sublimation purification device manufactured by Asahi Glassplant Inc.) to obtain a fullerene sublimate FLN sublimate). The sublimation of the raw material fullerene was performed in a three-zone system. A high-temperature zone was set to 700° C., a medium-temperature zone was set to 200° C., a low-temperature zone was set to room temperature, and the pressure of each zone was set to 10 pascals or less. The raw material fullerene was placed in the high-temperature zone and phase-changed from a solid to a gas, and solid fullerene sublimate which was phase-changed from a gas to a solid was collected from the medium-temperature zone.

Regarding the sublimation operation, the raw material fullerene was placed at room temperature, and each zone was depressurized until the pressure was 10 pascals or less. Thereafter, the temperatures of the high-temperature zone and the medium-temperature zone were simultaneously raised to a constant temperature at a rate of 10° C./min. The fullerene sublimation began when the temperature of the high-temperature zone was higher than 600° C., and the pressure during the sublimation was 10 pascals or less.

Next, 0.001 g of the obtained fullerene sublimate was mixed with 10 g of tris(2-octyldodecyl)cyclopentane (manufactured by Nye Lubricants, Synthetic Oil 2001A), which was a MAC oil as a base oil. The obtained mixture was stirred with a stirrer at room temperature for 36 hours. Next, this was filtered with a 0.1 μm mesh membrane filter to obtain a fullerene solution. The concentration of the fullerene in the obtained fullerene solution was measured, and the result was 100 mass ppm. The obtained fullerene solution was used as a lubricating oil composition.

The concentration of the above-described fullerene was measured using a high-performance liquid chromatograph (manufactured by Agilent Technologies, 1200 series). Specifically, using this device, the amount of fullerene in the sample such as a lubricating oil composition was determined by detecting an absorbance (wavelength of 309 nm) using a column YMC-Pack ODS-AM (150 mm×4.6) manufactured by YMC CO., LTD. and a 1:1 (volume ratio) mixture of toluene and methanol as a development solvent. In addition, a calibration curve was created from the above-described raw material fullerene.

(Evaluation of Abrasion Resistance)

The abrasion resistance of the obtained lubricating oil composition was evaluated using an abrasion resistance tester (manufactured by Anton Paar, Ball-On-Disc Tribometer).

First, a substrate and a ball were prepared, and the materials thereof were set to a high carbon chromium bearing steel material SUJ2. The diameter of the ball was set to 6 mm. The lubricating oil composition was applied to one main surface of the substrate, and the substrate was heated to 100° C. Next, the substrate was rotated and the fixed ball was slid on the one main surface of the substrate via the lubricating oil composition so that the ball drew a concentric orbit on the substrate. The speed of the ball on the one main surface of the substrate was set to 5 cm/sec, and the load of the ball on the one main surface of the substrate was set to 10 N. The rubbing surface (circle) of the ball surface, which was obtained when the sliding distance of the ball on the one main surface of the substrate was 300 m in total, was observed with an optical microscope. The diameter of the rubbing surface formed on the ball was measured, and the numerical value was considered as abrasion resistance. It can be said that the smaller the diameter of the rubbing surface, the better the abrasion resistance. The results are shown in Table 1.

(Evaluation of Stability)

The presence or absence of components which are volatilized from the lubricating oil composition under high vacuum was measured using a temperature-programmed desorption gas analyzer (manufactured by Rigaku Corporation, TPD type V). The degree of desorbed gas of 0.01 g of the lubricating oil composition was measured at an atmospheric pressure of $10^{-5}$ pascals. In order to eliminate the influence of molecules having a molecular weight smaller than that of carbonic acid gas (molecular weight of 44), an integrated value of peaks of molecular weights of 46 to 200 was obtained as a degree of desorbed gas. As a comparative product, a MAC oil to which 1 mass ppm of trimethylbenzene (TMB) (manufactured by Tokyo Chemical Industry Co., Ltd.) has been added as a volatile component was used, and the same measurement was carried out. Peaks due to TMB were detected in the measurement of the MAC oil to which TMB was added, and the integrated value of the peaks was used as 1 (reference value). The ratio of a measured integrated value of peaks which were originated from the desorbed gas of the lubricating oil composition to the reference value was obtained as a degree of desorbed gas. It can be said that the smaller the degree of desorbed gas, the better the stability under high vacuum.

The degree of desorbed gas was measured at two points, one before an abrasion resistance test and the other after the abrasion resistance test. In the above-described abrasion resistance test, a metal was brought into direct contact with the sample and heat was generated. Accordingly, molecular chains of a base oil broke and deteriorated. As a result of the deterioration, some of the broken molecules were detected as volatile components through the previous method. That is, since deterioration of a base oil proceeds in lubricating oil with poor abrasion resistance, the amount of desorbed gas component increases, which is not preferable. The results are shown in Table 1.

Comparative Example 1

A lubricating oil composition was obtained in the same manner as in Example 1 except that raw material fullerene (without sublimation step) was used as it is instead of the fullerene sublimate. The results of the degree of desorbed gas and the abrasion resistance of the obtained lubricating oil composition are shown in Table 1.

Comparative Example 2

A lubricating oil composition was obtained in the same manner as in Example 1 except that no fullerene was added to a MAC oil. The results of the degree of desorbed gas and the abrasion resistance of the obtained lubricating oil composition are shown in Table 1.

TABLE 1

| | Composition | | Fullerene | | Degree of desorbed gas from lubricating composition | |
|---|---|---|---|---|---|---|
| | of lubricating oil composition | Treatment for producing fullerene adduct | residual rate [—] | Diameter [μm] of rubbing surface | Before abrasion resistance test | After abrasion resistance test |
| Example 1 | MAC oil + FLN sublimate | None | 1.0 | 200 | 0.1 | 0.9 |
| Comparative Example 1 | MAC oil + FLN sublimate | None | 1.0 | 205 | 1.0 | 1.9 |
| Comparative Example 2 | MAC oil only | None | — | 300 | 0.1 | 2.4 |
| Example 2 | MAC oil + FLN sublimate | Ultraviolet irradiation (2 times) | 0.55 | 160 | 0.1 | 0.5 |
| Example 3 | MAC oil + FLN sublimate | Heating | 0.15 | 155 | 0.1 | 0.3 |

TABLE 1-continued

| | Composition of lubricating oil composition | Treatment for producing fullerene adduct | Fullerene residual rate [—] | Diameter [μm] of rubbing surface | Degree of desorbed gas from lubricating composition: Before abrasion resistance test | Degree of desorbed gas from lubricating composition: After abrasion resistance test |
|---|---|---|---|---|---|---|
| Example 4 | MAC oil + FLN sublimate | Ultraviolet irradiation (8 times) | 0.25 | 155 | 0.1 | 0.3 |
| Example 5 | MAC oil + FLN sublimate | 185 nm/254 nm wavelengths, for 20 seconds | 0.22 | 165 | 0.1 | 0.5 |
| Example 6 | MAC oil + FLN sublimate | X-ray irradiation, for 480 seconds | 0.20 | 180 | 0.1 | 0.8 |
| Example 7 | Ionic liquid + FLN sublimate | None | 1.00 | 250 | 0.1 | 1.0 |
| Comparative Example 3 | Ionic liquid + FLN | None | 1.00 | 250 | 1.1 | 2.0 |
| Example 8 | Ionic liquid + FLN sublimate | Heating | 0.12 | 200 | 0.1 | 0.3 |
| Example 9 | Ionic liquid + FLN sublimate | Ultraviolet irradiation (8 times) | 0.35 | 210 | 0.1 | 0.4 |
| Example 10 | Ionic liquid + FLN sublimate | None | 1.00 | 230 | 0.1 | 1.0 |
| Comparative Example 4 | Ionic liquid + FLN | None | 1.00 | 230 | 1.1 | 2.0 |
| Example 11 | Ionic liquid + FLN sublimate | Heating | 0.18 | 190 | 0.1 | 0.3 |
| Example 12 | Ionic liquid + FLN sublimate | Ultraviolet irradiation (8 times) | 0.40 | 195 | 0.1 | 0.4 |
| Example 13 | Ionic liquid + FLN sublimate | None | 1.00 | 220 | 0.1 | 0.9 |
| Comparative Example 5 | Ionic liquid + FLN | None | 1.00 | 220 | 1.0 | 1.9 |

It can be seen from Table 1 that, when a fullerene solution (lubricating oil composition) was obtained in Example 1 by dissolving the fullerene sublimate in a MAC oil, the abrasion resistance was excellent because the diameter of the rubbing surface was 200 μm. In addition, the degassing degree of the lubricating oil composition before the abrasion resistance test was 0.1, and it was found that the vapor pressure at an initial stage of use of the lubricating oil composition was low and the stability under high vacuum at an initial stage of use was excellent. Furthermore, the degassing degree of the lubricating oil composition after the abrasion resistance test was 0.9, and it was found that an increase in vapor pressure due to deterioration of a base oil was suppressed and the stability under high vacuum was excellent.

In addition, when comparing Example 1 with Comparative Example 1, although both had the same the abrasion resistance, the degrees of desorbed gas before and after the abrasion resistance test in Example 1 were superior to those of Comparative Example 1. It was inferred that this is because the sublimated fullerene (fullerene sublimate) substantially contained no volatile components, and the volatile components contained in the lubricating oil composition were reduced by adding the fullerene sublimate to the MAC oil, and as a result, the amount of desorbed gas could be minimized.

In addition, when comparing Example 1 with Comparative Example 2, both had an excellent degassing degree before the abrasion resistance to the same extent. However, in Comparative Example 2, the abrasion resistance deteriorated and the degassing degree after the abrasion resistance test was significantly inferior. From this, it was found that the abrasion resistance was improved by adding the fullerene sublimate to the MAC oil, and as a result, the increase in degassing amount was suppressed.

Example 2

A lubricating oil composition was obtained in the same manner as in Example 1 except that the fullerene solution (lubricating oil composition) obtained in Example 1 was irradiated with ultraviolet light. The results of the degree of desorbed gas and the abrasion resistance of the obtained lubricating oil composition are shown in Table 1.

The ultraviolet irradiation in Example 2 was performed according to the following procedure. First, 3 mL of the lubricating oil composition was taken out and added into a septum cap-attached quartz cell (manufactured by Tokyo Garasu Kikai Co., Ltd., S15-UV-10).

Next, two injection needles were inserted into the septum cap of the quartz cell, and nitrogen gas having a purity of 99.99% (the partial pressure of gases other than nitrogen at normal pressure was 10 pascals or less) was allowed to flow through one needle at 60 mL/min for 10 minutes. Next, the fullerene solution placed in the quartz cell was intermittently subjected to ultraviolet irradiation.

An ultraviolet irradiation device (manufactured by San-Ei Tech Ltd., OmniCure 52000) was used for the ultraviolet irradiation. Specifically, the mesh size of a filter was set to 250 nm to 450 nm, the output was adjusted to 1 W/cm$^2$ while measurement was performed using an ultraviolet illuminometer (wavelength of 230 nm to 390 nm) within an irradiation range of 2 cm$^2$, and the irradiation timer was set to 1 second. In addition, it was set so that 2 J of energy (0.7 J per milliliter of the fullerene solution) could be emitted with one irradiation.

Next, about 0.01 mL of the fullerene solution was sampled from the inside of the quartz cell after every ultraviolet irradiation using an injector, and the concentration of the fullerene was measured through high-performance liquid chromatography (HPLC) to determine the fullerene residual rate.

The fullerene residual rate was 0.55 after 2 times of ultraviolet irradiation (1.3 J per milliliter of the fullerene solution). Thus, the ultraviolet irradiation was stopped and the contents were taken out from the quartz cell to obtain a lubricating oil composition. The concentration of the fullerene in the lubricating oil composition was measured, and the result was 55 mass ppm. The fullerene residual rate was 0.55. The results are shown in Table 1.

In addition, the fullerene solution (lubricating oil composition of Example 1) before the ultraviolet irradiation and the lubricating oil composition of Example 2 obtained after the ultraviolet irradiation were subjected to a component analysis regarding components having a molecular weight of 720 to 2,000 using a mass spectrometer (manufactured by Agilent Technologies, LC/MS, 6120). In the fullerene solution of Example 1 before the ultraviolet irradiation, a main peak of 720 corresponding to the fullerene and a plurality of other peaks thought to be caused by a base oil were observed. In the lubricating oil composition of Example 2 after the ultraviolet irradiation, peaks of m/z=750, 764, 766, 778, 780, 792, 794, 796, 808, 806, 820, and 834 were newly confirmed as main peaks in addition to the above-described peaks. From these findings, it was confirmed that the fullerene solution (lubricating oil composition) after the ultraviolet irradiation includes a fullerene and a fullerene adduct produced. Fullerene solutions before and after a heat treatment or a radiation treatment were also analyzed in other examples and comparative examples. As a result, no fullerene adduct was confirmed in the fullerene solutions before the heat treatment or the radiation treatment, but confirmed in the fullerene solutions after these treatments.

Example 3

A fullerene solution placed in a quartz cell was immersed in an oil bath at 200° C. and heated instead of the ultraviolet irradiation. A lubricating oil composition was obtained in the same manner as in Example 2 except that heating was performed instead of the ultraviolet irradiation. The results of the degree of desorbed gas and the abrasion resistance of the obtained lubricating oil composition are shown in Table 1.

In the heating in Example 3, about 0.01 mL of the fullerene solution was sampled from the inside of the quartz cell every 5 minutes using an injector, and the concentration of the fullerene was measured through HPLC to determine the fullerene residual rate. The fullerene residual rate 15 minutes after the start of the measurement was 0.2. Thus, the quartz cell was taken out from the oil bath and cooled to room temperature to obtain a lubricating oil composition. The concentration of the fullerene in the lubricating oil composition was measured, and the result was 15 mass ppm. The fullerene residual rate was 0.15.

As shown in Table 1, in Example 2, when the fullerene solution was obtained by dissolving the fullerene sublimate in a MAC oil and irradiated with ultraviolet light twice, the diameter of the rubbing surface was 160 μm and the degassing degrees of the lubricating oil composition before and after the abrasion resistance test were respectively 0.1 and 0.5. That is, it was found that the abrasion resistance and the stability under high vacuum were superior. Similarly, in Example 3, when the fullerene solution was obtained by dissolving the fullerene sublimate in a MAC oil and subjected to heat treatment, the diameter of the rubbing surface was 155 μm and the degassing degrees of the lubricating oil composition before and after the abrasion resistance test were respectively 0.1 and 0.3. That is, it was found that the abrasion resistance and the stability under high vacuum were superior.

In addition, when comparing Examples 2 and 3 in which ultraviolet irradiation or heating was performed as a step of producing a fullerene adduct with Example 1 in which the above-described ultraviolet irradiation or the heating was not performed, both of the abrasion resistance and the degree of desorbed gas before and after an abrasion resistance test in Examples 2 and 3 were excellent. It was inferred that a fullerene adduct would be produced in the fullerene solutions through the above-described step of producing a fullerene adduct, and as a result, the abrasion resistance improved and the amount of volatile components could be minimized due to the improved abrasion resistance.

Example 4

A lubricating oil composition was obtained in the same manner as in Example 2 except that a fullerene solution was irradiated with ultraviolet light 8 times. In Example 4, the fullerene residual rate was 0.25 after 8 times of ultraviolet irradiation (5.3 J per milliliter of the fullerene solution). Thus, the ultraviolet irradiation was stopped and the contents were taken out from the quartz cell to obtain a lubricating oil composition. The concentration of the fullerene in the lubricating oil composition was measured, and the result was 25 mass ppm. The fullerene residual rate was 0.25. The results of the degree of desorbed gas and the abrasion resistance of the obtained lubricating oil composition are shown in Table 1.

As shown in Table 1, in Example 4, when the fullerene solution was irradiated with ultraviolet light 8 times, the diameter of the rubbing surface was 155 μnn and the degassing degrees of the lubricating oil composition before and after the abrasion resistance test were respectively 0.1 and 0.3. That is, it was found that the abrasion resistance and the stability under high vacuum were superior.

In addition, when comparing Example 4 with Example 2, both the abrasion resistance and degree of desorbed gas after the abrasion resistance test in Example 4 were superior to those of Example 2. Examples 2 and 4 have the same conditions except that the number of times of ultraviolet irradiation is different. Accordingly, it is estimated that, in Examples 2 and 4, the types of cleaved molecules (additional groups of fullerene adduct) produced are almost the same as each other, and the difference is that the fullerene residual rate of Example 4 is lower than that of Example 2, that is, a larger amount of the fullerene adduct was produced in Example 4. It is inferred that, due to this difference, the abrasion resistance would be improved in Example 4, and as a result, the degree of desorbed gas after the abrasion resistance test would also be lowered.

Example 5

A lubricating oil composition was obtained in the same manner as in Example 1 except that irradiation using a low-pressure mercury UV lamp (Sen Lights Co., Ltd., model UVL20PH-6 including ultraviolet light at 185 nm and 254 nm as light wavelength components) as a light source of radiation was performed for 20 seconds. Here, the irradiation range was 5 $cm^2$, and the output was 0.2 $W/cm^2$. That is, the lubricating oil composition was irradiated with 20 J of ultraviolet light (7 J per milliliter of a fullerene solution) for 20 seconds. The concentration of fullerene in the lubricating oil composition was measured, and the result was 22 mass ppm and the fullerene residual rate was 0.22. The results of the degree of desorbed gas and the results of the abrasion resistance of the obtained lubricating oil composition are shown in Table 1.

Example 6

A lubricating oil composition was obtained in the same manner as in Example 1 except that X-ray irradiation was performed for 480 seconds using an X-ray irradiation device (Toreck Co., Ltd., RIX-250C-2) as a light source of radiation. The concentration of fullerene in the obtained lubricating oil composition was measured, and the result was 20 mass ppm and the fullerene residual rate was 0.20. The degree of desorbed gas and the abrasion resistance of the obtained lubricating oil composition are shown in Table 1.

When comparing Example 5 with Example 4, both were subjected to ultraviolet irradiation, and as a result, the fullerene residual rate was lowered to the same extent. However, the abrasion resistance and the degree of desorbed gas after the abrasion resistance test in Example 4 were superior to those of Example 5. It is inferred that this is because light (far ultraviolet light) at 185 nm would be included in ultraviolet light in Example 5.

When comparing Example 6 with Example 5, both were subjected to irradiation, and as a result, the fullerene residual rate was lowered to the same extent. However, the abrasion resistance and the degree of desorbed gas after the abrasion resistance test in Example 6 were inferior to those of Example 5. It is inferred that this is because X-rays having higher energy than ultraviolet light were used as radiation in Example 6.

Example 7

A lubricating oil composition was obtained in the same manner as in Example 1 except that 1-butyl-3-methylimidazolium-bis(trifluoromethanesulfonyl)imide (manufactured by Tokyo Chemical Industry Co., Ltd., LiTFS1), which is an ionic liquid, was used as a base oil. The results of the degree of desorbed gas and the abrasion resistance of the obtained lubricating oil composition are shown in Table 1.

Comparative Example 3

A lubricating oil composition was obtained in the same manner as in Example 7 except that raw material fullerene (without sublimation step) was used as it is instead of the fullerene sublimate. The results of the degree of desorbed gas and the abrasion resistance of the obtained lubricating oil composition are shown in Table 1.

When comparing Example 7 with Comparative Example 3, Example 7 in which the fullerene sublimate was used had excellent degrees of desorbed gas before and after the abrasion resistance test.

Example 8

A lubricating oil composition was obtained in the same manner as in Example 3 except that 1-decyl-3-methylimidazolium-bis(trifluoromethanesulfonyl)imide (manufactured by Tokyo Chemical Industry Co., Ltd.), which is an ionic liquid, was used as a base oil. The concentration of fullerene in the lubricating oil composition was measured, and the result was 12 mass ppm and the fullerene residual rate was 0.12. The degree of desorbed gas and the abrasion resistance of the obtained lubricating oil composition are shown in Table 1. The degree of desorbed gas and the abrasion resistance of the obtained lubricating oil composition are shown in Table 1.

Example 9

A lubricating oil composition was obtained in the same manner as in Example 4 except that 1-decyl-3-methylimidazolium-bis(trifluoromethanesulfonyl)imide (manufactured by Tokyo Chemical Industry Co., Ltd.), which is an ionic liquid, was used as a base oil. The concentration of fullerene in the lubricating oil composition was measured, and the result was 35 mass ppm and the fullerene residual rate was 0.35. The degree of desorbed gas and the abrasion resistance of the obtained lubricating oil composition are shown in Table 1. The degree of desorbed gas and the abrasion resistance of the obtained lubricating oil composition are shown in Table 1.

Comparison results of Examples 8 and 9 with Example 7 showed the same tendency as the above-described comparison results of Examples 3 and 4 with Example 1. That is, it was found that the ultraviolet irradiation treatment and the heat treatment were effective even in different base oils from the viewpoints of the abrasion resistance effects and reduction of degassing.

Example 10

A lubricating oil composition was obtained in the same manner as in Example 1 except that 1-ethyl-3-methylimidazolium-bis(fluorosulfonyl)imide, which is an ionic liquid, was used as a base oil. The degree of desorbed gas and the abrasion resistance of the obtained lubricating oil composition are shown in Table 1.

Comparative Example 4

A lubricating oil composition was obtained in the same manner as in Example 10 except that raw material fullerene (without sublimation step) was used as it is instead of the fullerene sublimate. The results of the degree of desorbed gas and the abrasion resistance of the obtained lubricating oil composition are shown in Table 1.

When comparing Example 10 with Comparative Example 4, Example 10 in which the fullerene sublimate was used had superior degrees of desorbed gas before and after the abrasion resistance test than Comparative Example 5.

Example 11

A lubricating oil composition was obtained in the same manner as in Example 3 except that 1-ethyl-3-methylimidazolium-bis(fluorosulfonyl)imide, which is an ionic liquid, was used as a base oil. The concentration of fullerene in the lubricating oil composition was measured, and the result was 18 mass ppm and the fullerene residual rate was 0.18. The degree of desorbed gas and the abrasion resistance of the obtained lubricating oil composition are shown in Table 1.

Example 12

A lubricating oil composition was obtained in the same manner as in Example 4 except that 1-ethyl-3-methylimidazolium-bis(fluorosulfonyl)imide, which is an ionic liquid, was used as a base oil. The concentration of fullerene in the lubricating oil composition was measured, and the result was 40 mass ppm and the fullerene residual rate was 0.40. The degree of desorbed gas and the abrasion resistance of the obtained lubricating oil composition are shown in Table 1.

Comparison results of Examples 11 and 12 with Example 10 showed the same tendency as the above-described comparison results of Examples 8 and 9 with Example 7. That is, it was found that the ultraviolet irradiation treatment and the heat treatment were effective even in different ionic liquids from the viewpoints of the abrasion resistance results and reduction of degassing.

Example 13

A lubricating oil composition was obtained in the same manner as in Example 1 except that 1-butyl-4-methylpyridium-bis(fluorosulfonyl)imide, which is an ionic liquid, was used as a base oil. The degree of desorbed gas and the abrasion resistance of the obtained lubricating oil composition are shown in Table 1.

Comparative Example 5

A lubricating oil composition was obtained in the same manner as in Example 13 except that raw material fullerene (without sublimation step) was used as it is instead of the fullerene sublimate. The degree of desorbed gas and the abrasion resistance of the obtained lubricating oil composition are shown in Table 1.

When comparing Example 13 with Comparative Example 5, Example 13 in which the fullerene sublimate was used had excellent degrees of desorbed gas before and after the abrasion resistance test. This was the same as the above-described comparison result of Example 1 with Comparative Example 1 and the above-described comparison result of Example 7 with Comparative Example 3. That is, it was found that use of fullerene sublimate was effective even in different base oils from the viewpoint of reducing the degree of desorbed gas.

INDUSTRIAL APPLICABILITY

According to the present invention, it is possible to provide a lubricating oil composition which has a low vapor pressure and in which excellent abrasion resistance can be exhibited, an increase in vapor pressure due to deterioration of a base oil can be suppressed, and lubricating performance can be stably maintained over a long period of time even under vacuum.

The lubricating oil composition of the present embodiment is suitable for various oils such as: industrial gear oil; hydraulic oil; compressor oil; refrigerator oil; cutting oil; plastic working oils such as rolling oil, pressing oil, forging oil, drawing oil, drawing oil, and punching oil; metal working oils such as heat treatment oil and electric discharge machining oil; sliding guide surface oil; bearing oil; rust-proof oil; and heat medium oil. In particular, the lubricating oil composition thereof is suitable as various oils used in vacuum states, that is, used in outer space or in vacuum containers provided in vacuum apparatuses.

In addition, the lubricating oil composition of the present invention is useful for devices and equipment used in high altitude regions or outer space. For example, the lubricating oil composition thereof is significantly useful for long-term suppression of damage or abrasion of metal parts under vacuum in, for example, sliding portions of devices or equipment mounted on aircraft, spacecraft, rockets, probes, space stations, and satellites. In addition, the lubricating oil composition of the present invention is significantly useful for long-term suppression of damage or abrasion of metal parts in sliding portions of vacuum containers provided in vacuum apparatuses such as a vacuum metallurgical device for forging, joining, or the like, a vacuum chemical device for performing a chemical reaction or the like, a vacuum thin film-forming/processing device for vapor deposition, sputtering, or the like, an analyzer such as an electron microscope, and a vacuum test device for performing bending/tensile/compression tests or the like.

The invention claimed is:

1. A lubricating oil composition, comprising:
a fullerene and
a base oil,
wherein the fullerene is a fullerene sublimate,
wherein the fullerene sublimate is a fullerene substantially free of volatile components, and
wherein the base oil is a multiply alkylated cyclopentane oil or an ionic liquid.

2. The lubricating oil composition according to claim 1, further comprising:
a fullerene adduct,
wherein the fullerene adduct has a structure in which an additional group has been added to the fullerene, wherein the additional group has a part of a molecular structure which constitutes the base oil.

3. A method for producing the lubricating oil composition according to claim 1, the method comprising:
a dissolution step of dissolving a fullerene sublimate in a base oil to obtain a fullerene solution.

4. The method for producing a lubricating oil composition according to claim 3, the method further comprising:
a sublimation step of sublimating and vaporizing a raw material fullerene in a non-oxidizing atmosphere, and then cooling and solidifying the vaporized fullerene to obtain the fullerene sublimate, before the dissolution step.

5. The method for producing a lubricating oil composition according to claim 3,
wherein the fullerene sublimate contains $C_{60}$ or $C_{70}$ or a mixture thereof.

6. The method for producing a lubricating oil composition according to claim 3, the method further comprising:
a removal step of removing insoluble components from the fullerene solution after the dissolution step.

7. The method for producing a lubricating oil composition according to claim 3, the method further comprising:
a heat treatment step of subjecting the fullerene solution to a heat treatment in a non-oxidizing atmosphere after the dissolution step to produce a fullerene adduct.

8. The method for producing a lubricating oil composition according to claim 7,
wherein a temperature during the heat treatment in the heat treatment step is within a range of higher than an upper limit usage temperature of the base oil and lower than or equal to the upper limit usage temperature+200° C.

9. The method for producing a lubricating oil composition according to claim 7,
wherein a temperature of the heat treatment in the heat treatment step is 150° C. to 300° C.

10. The method for producing a lubricating oil composition according to claim 3, the method further comprising:
a radiation treatment step of irradiating the fullerene solution with radiation in a non-oxidizing atmosphere after the dissolution step to produce a fullerene adduct,
wherein the radiation is ultraviolet light or ionizing radiation.

11. The method for producing a lubricating oil composition according to claim 10,
wherein the radiation is ultraviolet light having a wavelength of 190 nm to 365 nm.

12. The method for producing a lubricating oil composition according to claim 10, wherein the amount of energy of the radiation emitted in the radiation treatment step is 1 J to 100 J per milliliter of the fullerene solution.

13. The method for producing a lubricating oil composition according to claim 7, wherein an oxygen partial pressure in the non-oxidizing atmosphere is less than or equal to 10 pascals.

14. The method for producing a lubricating oil composition according to claim 7, wherein the heat treatment step or the radiation treatment step is performed until a concentration of the fullerene in the fullerene solution is 0.1 times to 0.7 times a concentration of the fullerene obtained before the heat treatment step or the radiation treatment step.

15. The method for producing a lubricating oil composition according to claim 14, wherein a treatment time of the heat treatment step or the radiation treatment step is 5 minutes to 24 hours.

16. A vacuum apparatus, comprising:

a vacuum container which contains the lubricating oil composition according to claim 1.

17. The lubricating oil composition according to claim 1, wherein the fullerene consists of the fullerene sublimate, and the base oil consists of the multiply alkylated cyclopentane oil or the ionic liquid.

18. The lubricating oil composition according to claim 1, wherein a concentration of the fullerene sublimate in the lubricating oil composition is 0.0001 mass % to 0.010 mass %, and an amount of the base oil in the lubricating oil composition is 90.0000 mass % to 99.9999 mass %.

* * * * *